US009848257B2

(12) United States Patent
Ambrose

(10) Patent No.: US 9,848,257 B2
(45) Date of Patent: Dec. 19, 2017

(54) IN-EAR HEARING DEVICE AND BROADCAST STREAMING SYSTEM

(71) Applicant: ASIUS TECHNOLOGIES, LLC., Longmont, CO (US)

(72) Inventor: Stephen D. Ambrose, Longmont, CO (US)

(73) Assignee: ASIUS TECHNOLOGIES, LLC, Longmont, CO (US)

( * ) Notice: Subject to any disclaimer, the term of this patent is extended or adjusted under 35 U.S.C. 154(b) by 0 days.

(21) Appl. No.: 14/932,377

(22) Filed: Nov. 4, 2015

(65) Prior Publication Data

US 2016/0127818 A1 May 5, 2016

Related U.S. Application Data

(60) Provisional application No. 62/075,107, filed on Nov. 4, 2014.

(51) Int. Cl.
*H04R 25/00* (2006.01)
*H04R 1/10* (2006.01)
*H04R 31/00* (2006.01)

(52) U.S. Cl.
CPC ..... *H04R 1/1016* (2013.01); *H04R 1/1066* (2013.01); *H04R 1/1091* (2013.01); *H04R 31/006* (2013.01); *H04R 2460/11* (2013.01)

(58) Field of Classification Search
CPC .. H04R 25/30; H04R 25/554; H04R 2460/05; H04R 25/70; H04R 2225/025; H04R 2225/61
USPC ..... 381/370, 380, 381, 371, 373; 181/129, 181/130, 131; 379/430, 431
See application file for complete search history.

(56) References Cited

U.S. PATENT DOCUMENTS

| | | | | |
|---|---|---|---|---|
| 4,239,945 | A | 12/1980 | Atoji et al. | |
| 4,742,887 | A | 5/1988 | Yamagishi | |
| 4,852,177 | A | 7/1989 | Ambrose | |
| 8,340,310 | B2 | 12/2012 | Ambrose et al. | |
| D677,653 | S * | 3/2013 | Cantoni | D14/223 |
| 8,391,534 | B2 | 3/2013 | Ambrose et al. | |
| D691,594 | S | 10/2013 | Akana et al. | |

(Continued)

*Primary Examiner* — Md S Elahee
*Assistant Examiner* — Julie X Dang
(74) *Attorney, Agent, or Firm* — Marvin Petry; Stites & Harbison PLLC

(57) ABSTRACT

An improved earbud design providing for full modularity; improved and variable hearing protection, sound quality, comfort, fit, aesthetics, and signal connectivity; and the ability to maintain environmental sound directionality comprised of a multitude of new features with variable vents and membranes which dilute the harmful pneumatic effects of sound while improving its acoustic quality. A location-based transmission system provides event attendees to mix live sound with streamed sound through Ambrose Earbuds for reduced hearing risk and no quality detriments due to timing gaps, occlusion or ear tip spectral broadening, and enables noise pollution-free musical performances. A displacement-based digital compression algorithm caps maximum output air displacement as well as sound pressure level. Thus, an earbud is provided that through adjustments and modularity can act as a personal listening device, a hearing protection device and as a personal aesthetic statement with customized fit and comfort.

31 Claims, 8 Drawing Sheets

(56) References Cited

U.S. PATENT DOCUMENTS

| | | | | |
|---|---|---|---|---|
| 8,638,971 | B2 | 1/2014 | Hayashida | |
| 8,737,635 | B2 | 5/2014 | Ambrose et al. | |
| 8,774,435 | B2 | 7/2014 | Ambrose et al. | |
| 2002/0080990 | A1* | 6/2002 | Lin | H04R 1/1016 381/380 |
| 2007/0036385 | A1* | 2/2007 | Harvey | H04R 1/2819 381/388 |
| 2007/0189570 | A1* | 8/2007 | Matsuo | H04R 1/1016 381/382 |
| 2007/0223717 | A1* | 9/2007 | Boersma | H04M 1/6058 381/74 |
| 2009/0220113 | A1* | 9/2009 | Tiscareno | H04R 1/403 381/309 |
| 2010/0198135 | A1* | 8/2010 | Morriss | A61F 11/00 604/21 |
| 2011/0135136 | A1* | 6/2011 | Kim | H04R 1/1016 381/380 |
| 2012/0057734 | A1 | 3/2012 | Ambrose et al. | |
| 2013/0343594 | A1* | 12/2013 | Howes | H04R 1/1016 381/380 |
| 2015/0163586 | A1 | 6/2015 | Ambrose et al. | |
| 2015/0304759 | A1 | 10/2015 | Ambrose et al. | |
| 2015/0304774 | A1 | 10/2015 | Ambrose et al. | |

* cited by examiner

Fig. 4A
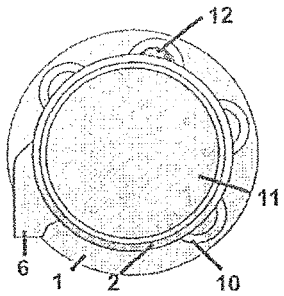
Fig. 4B
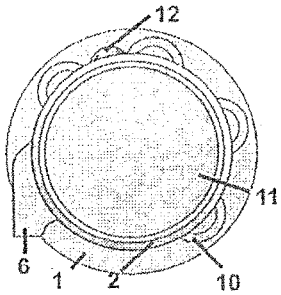
Fig. 4C
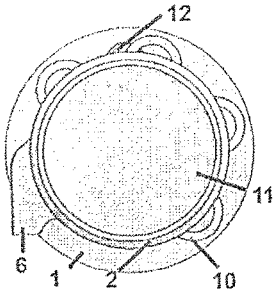
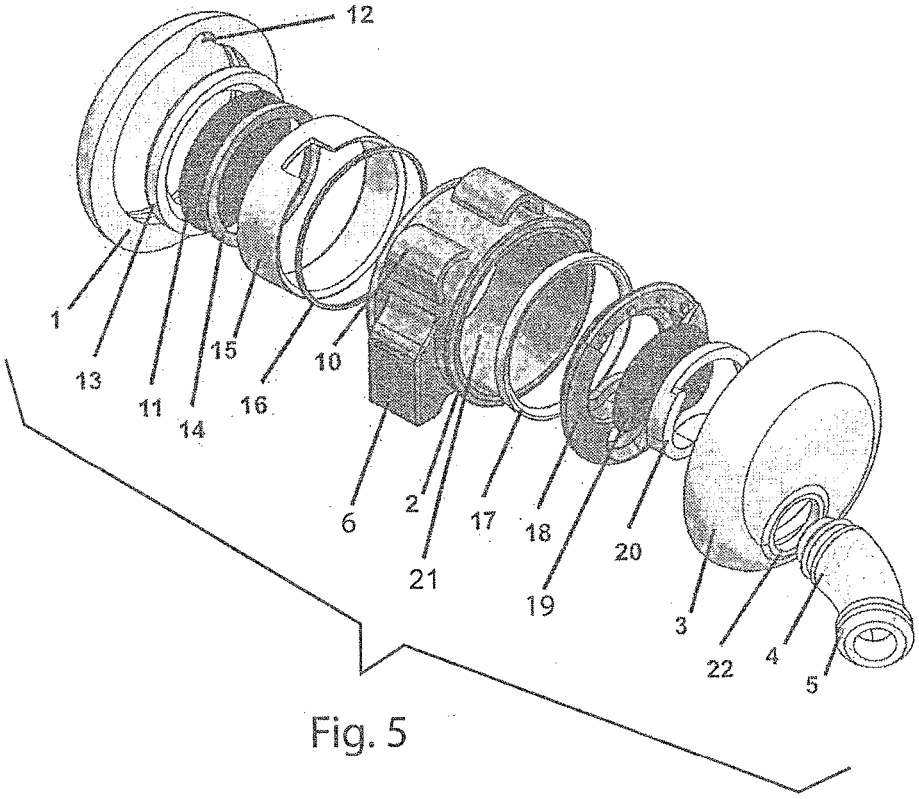
Fig. 5

Fig. 6
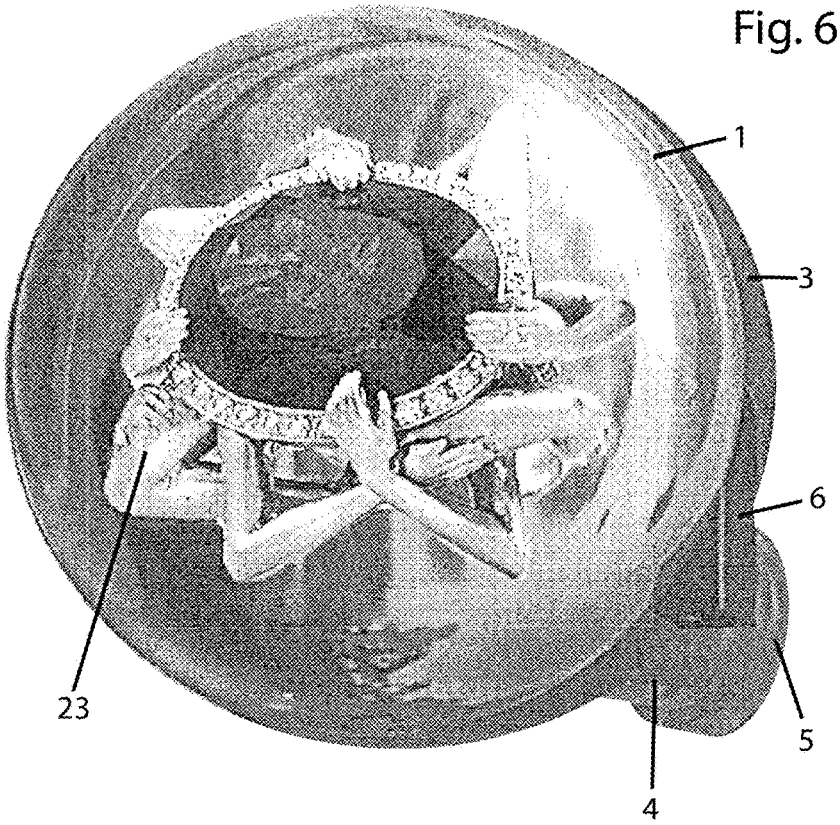
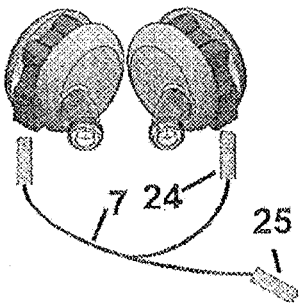
Fig. 7A
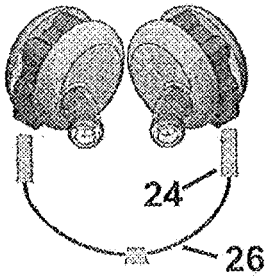
Fig. 7B
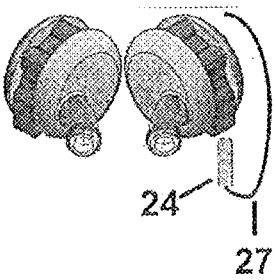
Fig. 7C

Graphic 1 Equal Loudness Curves (Phons) for an open ear canal across the audible frequency (ISO 226:2003) and the associated Sound Pressure Levels (SPLs) in decibels (dB) and the amplification of Pneumatic Air Pressure due to sound with an amplification of 1 set at 1 kHz and 20 micro-Pascals (microPa).

Fig. 11A
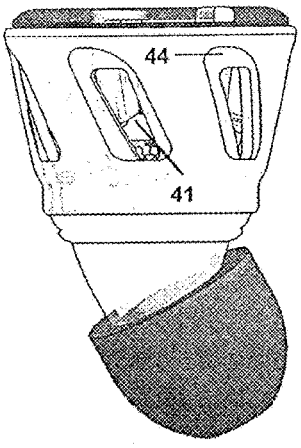
Fig. 11B
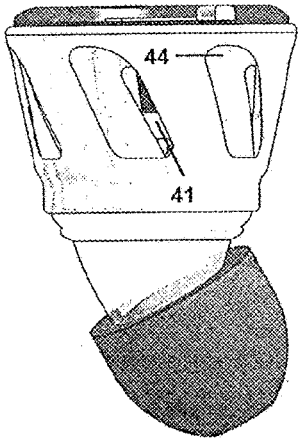
Fig. 11C
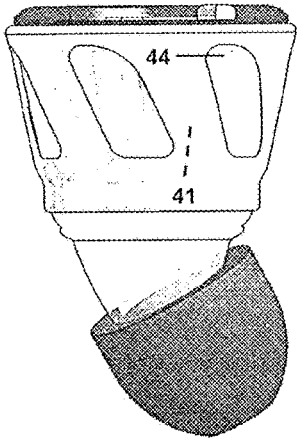
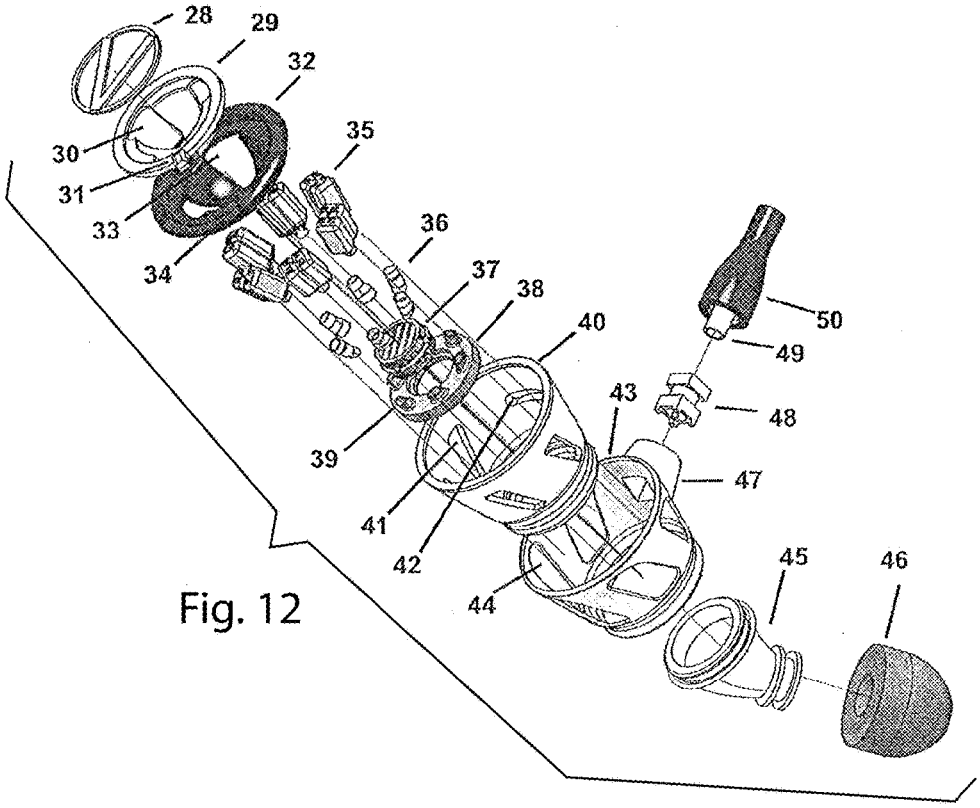
Fig. 12

Fig. 13A
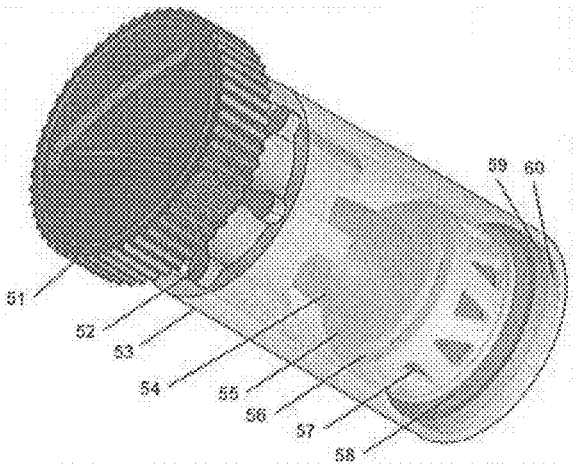
Fig. 13B
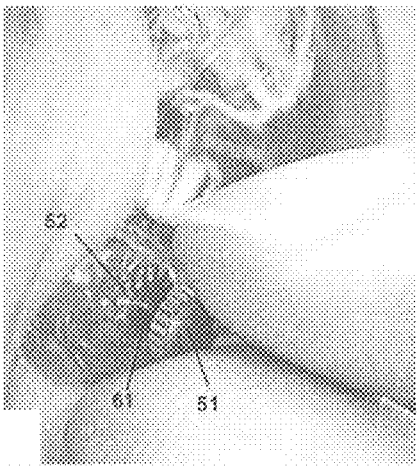
Fig. 14A
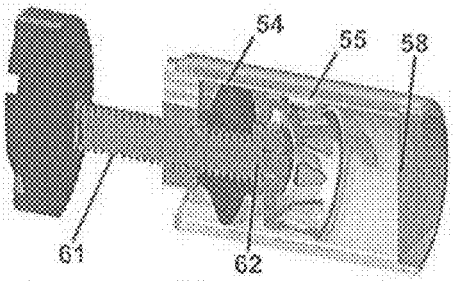
Fig. 14B
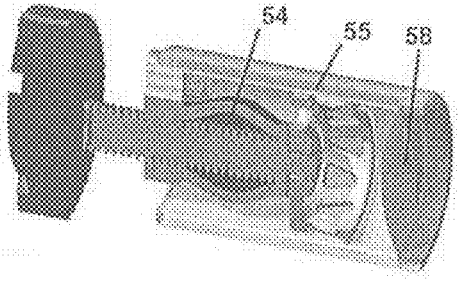
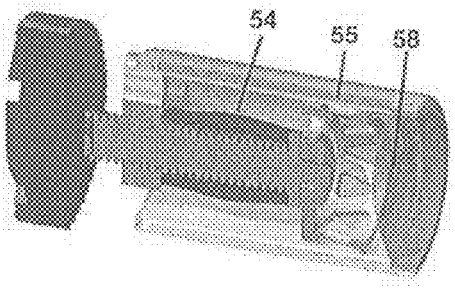
Fig. 14C
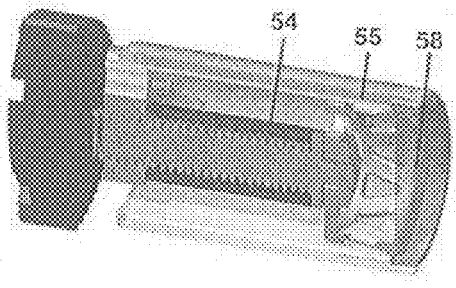
Fig. 14D

IN-EAR HEARING DEVICE AND BROADCAST STREAMING SYSTEM

RELATED APPLICATION

The present application claims the benefit of U.S. Provisional Application No. 62/075,107, filed Nov. 4, 2014, the complete content of which is hereby incorporated by reference.

BACKGROUND OF THE INVENTION OF THE INVENTION

The inventions covered in this application relate to Ear Buds, In Ear Monitors, Hearing Aids and all related personal listening devices (hereafter collectively referred to as "earbuds").

More specifically, they relate to high fidelity earbud hearing protection and health while affording enhanced sound quality, isolation, fit, aesthetics, overall customizability characteristics, Bluetooth connectivity, the reduction of event-based hearing damage/noise pollution through their use at concerts, sports events, etc., live broadcast and location based syncing of at-event wireless audio streaming to smartphones and similar WiFi or Bluetooth devices, —as well as a novel displacement-based digital audio compression algorithm which electronically mitigates premature triggering of the acoustic reflex thereby allowing lower in-ear volumes to sound louder than conventional couplings which are known to cause hearing loss.

Earbuds provide utility as portable and private audio devices and are sometimes improperly employed to inadequately isolate the user from external sounds while listening to in/on-ear audio [U.S. Pat. Nos. 4,239,945; 4,742,887; 8,638,971B2]. Utilizing an ear tip, ear mold or ear cushion, earbuds partially or wholly seal the ear canal in an effort to increase the isolation from external sounds as well as increase the retention of both the device and the amplified sound within or around the ear. However, formal studies show their regular use leads directly to permanent hearing damage.

Large, high intensity transducer membrane excursions (i.e. the vibratory back and forth movements of the speaker diaphragm) are necessary for the audible propagation of acoustic sound waves by earbuds. However, under partially or wholly sealed in-ear conditions, these relatively huge motions result in harmful oscillating pneumatic air pressures within the enclosed canal volume which overly impinge a significant percentage of the speaker diaphragm excursions directly onto the delicate and highly sensitive tympanic membrane, thereby overwhelming the natural compliance of the ear drum. Typical earbud/headphone speaker excursions range from microns to millimeters while normal tympanic membrane excursions range from only 100 to 250 nanometers, or roughly 1000 times smaller than typical speaker excursions.

Additionally, broadband, pneumatically coupled, in-ear sound pressures prematurely trigger the acoustic reflex, wherein, the tensor tympani muscle tightens the tympanic membrane, and the stapedius muscle pulls on and stiffens the ossicular chain, drawing the stapes away from the cochlea's oval window. This premature triggering often occurs as low as 60 dB when the ear canal is partially or wholly sealed instead of its typical audiologically established 88-90 dB threshold for an open ear canal.

Under these conditions, the net result of this premature triggering of the acoustic reflex is that sound waves are far less efficiently passed through to the inner ear, while their broadband pneumatic components continue to overly impinge on the tympanic membrane. Overall listening volumes are significantly less audible. The typical user response to this involuntary reflex is to turn the audio volume up much higher, resulting in international efforts to advise users of the dangers attendant upon listening to earbuds at excessive volume levels. This situation continues quite unresolved, resulting in habitual, overwhelming pressures on the tympanic membrane and leading to dramatic worldwide increases in permanent hearing loss.

The occlusion effect—i.e. bone conduction of one's own internal voice and body sounds resonating within the sealed ear canal (including transduction of external sound waves through vibrating bones, fluids, body cavities, tissues and in-ear devices) is the result of displacement based oscillating pneumatic air pressures from vibrating in ear surfaces which are then overly impinged onto both the tympanic membrane and the middle ear: sounds which are normally inaudible under unsealed conditions are pneumatically amplified as much as 1000 times (60 dB) over their normally unsealed volume levels. For example, one is able to easily hear the normally inaudible internal sounds of their own jaw motions or blood pumping amplified many times by simply plugging and sealing their ears with their fingers or foam ear plugs.

The confining of acoustically driven mechanical surface vibrations into relatively small, trapped volumes such as the ear canal results in unintended pneumatic displacement based in-ear acoustical amplifications similar to the intentional amplifications provided by stethoscopes, woodwinds, brass instruments, etc. All of these instruments gain their intended amplification through the principle of the pneumatic coupling of enclosed displacement based pneumatic pressures. This principle results in hearing loss when unwittingly applied to the ear because it is masked by the acoustic reflex and unrealized by the listener over time.

As described above, when the outer portion of the ear canal is sealed, in-ear sounds are significantly amplified by their aforementioned transformation into oscillatory pneumatic pressures, regardless of whether or not an active audio speaker is also present. However, this phenomena becomes greatly exaggerated when the normal diaphragm excursions of earbud speakers are introduced concurrent with mandibular (jawbone) deformations of the occluded ear canal walls such as those which occur during talking, singing, chewing, and yawning, —since all of these common physiological conditions independently create large increases in pneumatic in-ear pressures when the ear canal surfaces are exposed yet externally sealed and their accumulating pressures are thereby kept from immediately equalizing with normal external barometric pressure.

When earbuds conventionally seal the ear canal, these physiological conditions compound with transducer based in-ear sound pressures and together, dramatically increase the overall oscillating pneumatic pressure on the tympanic membrane by as much as 1 kPa or more. As already observed, this condition prematurely triggers the acoustic reflex, thereby demanding excessive listening volumes leading to hearing loss.

Conventional solutions to reducing the occlusion effect while wearing earbuds involve the introduction of leaks or vents into the chamber in front of the speaker. These leaks are acoustic as well as pneumatic and result in reduced volume levels, degraded bass frequency response and inadequate isolation and thereby demand higher listening volumes since the speaker is now driving a greatly enlarged or even unenclosed chamber. Here again, the typical user response has been to resort to excessive listening volumes. Unavoidable, accidental improved sealing conditions such as occur when shoving the device in deeper or leaning the ear containing the earbud up against a pillow or headrest often results in extremely high volumes which create pain and hearing loss before the person can easily respond, since the acoustic reflex greatly masks the condition.

Additionally, many conventional acoustic ear-coupling approaches use a hard, smooth surface for the ear tip or ear mold. Under conditions of mandibular deformation, such a surface forms an inconsistent seal, thus an intermittent leak between the coupler and the ear canal is inevitable, resulting in inconsistent coupling, degraded sound quality and inadequate isolation.

Some earbud designs utilize screened airflow channels independent of ear tip design to vent the front chamber air within the speaker housing to the outside, barometric pressure air. The Apple earbud design of 2013, for example, incorporates both venting methods [U.S. Pat. No. D691,594S] of the screened airflow channels and the hard, smooth ear tip surface. As described above, these solutions demand increased listening volumes.

Under wholly or partially sealed conditions, pneumatic pressures impede the motion of an earbud speaker. As the speaker moves within a sealed chamber, it inadvertently and variably compresses the trapped air into a smaller volume. As air is semi-incompressible, it resists, preventing the speaker from performing its intended linear excursion. Unlike unsealed conditions, the pressures created are nonlinear. Thusly impeded, the speaker exhibits slower transient responses, generating muddled, damped, lower quality sounds, which are especially nonlinear in the bass frequencies. Additionally, the natural performance of the Helmholtz resonance of the ear canal is significantly degraded.

In contrast, small air vents or screens are routinely employed in the back chamber of earbud speakers to allow similarly compressed air to escape and new air to flow in during rarefactions, thereby allowing the speaker to move more freely.

Under sealed conditions, the premature triggering of the acoustic reflex results in the stiffened compliance of the tympanic membrane variably determining the level of impedance on the speaker diaphragm facing the ear canal chamber, contributing significantly to the nonlinear functioning of both the speaker diaphragm and the tympanic membrane and thereby further degrading audio performance.

The aforementioned open-air pressure vents and leaks also act as acoustic vents. Employed in the chamber comprising the ear canal, sound amplitude and quality, particularly in the lower spectral regions, is significantly reduced with their use and listeners once again choose high audio volumes to recover the signal.

The Ambrose Diaphonic Ear Lens (ADEL) In-Ear Bubble invented by Stephen Ambrose (U.S. Pat. Nos. 8,340,310 B2 and 8,391,534 B2) significantly mitigates the shortcomings of conventional coupling systems such as common ear molds and ear tips. The inflatable ADEL ear tip is made of a highly flexible material, which when inflated, forms an effective, consistent and comfortable acoustic seal with the ear canal, despite physical exercise and mandibular deformations. The pressure exerted on the ear canal is sufficiently minimal that the presence of an ADEL disappears from the user's perception.

The ADEL is more compliant than the tympanic membrane by several orders of magnitude and is able to both absorb pneumatic pressures from within the sealed canal and reflect a greatly reduced return wave back onto the tympanic membrane. Unwanted reflections and resonances are substantially reduced.

The extremely low mass, low impedance mechanical excursion response of the ADEL membrane is much faster than both the speaker diaphragm and the tympanic membrane and results in ideal (extremely fast and high resolution) in-ear frequency/transient/dynamic range response—therefore significantly improving the performance and sound quality of any speaker mechanically coupled to the ear.

The inflatable ADEL very easily and comfortably enters, fills and displaces the full volume of the ear canal and thereby significantly reduces the occlusion effect. The tympanic membrane receives a more natural and healthy level of sound, the stapedius reflex does not prematurely trigger, the occlusion effect is minimized or removed, and the user perceives a much improved quality of sound throughout their listening experience without having to resort to excessive sound levels.

The passive, un-inflated ADEL absorbs the aforementioned pneumatic components of enclosed in-ear sound waves and thereby effectively lessens the occlusion effect as well as all the other unwanted conditions described above.

Many earbuds on the market are advertised as providing sound isolation. The isolation from exterior sounds is achieved by sealing the ear with unattractive, uncomfortable and noncompliant ear molds or over-sized foam or mushroom-shaped ear tips or with moldable materials such as self-curing silicones or wax.

In addition to being uncomfortable, conventional coupling methods often become dislodged, variably leak or introduce the occlusion effect (the unwanted booming bass of one's own voice), provide inadequate and inconsistent isolation/acoustic sealing and degrade the quality of in-ear acoustics by damping, exaggerating, muffling and blurring the source sound. Dedicated, sound isolating earbuds also operate under an all-or-nothing premise. The user must dislodge them to hear external sounds and replace them to hear the speaker and block off external sound.

Most available earbuds fit their users poorly and uncomfortably and their aesthetics tend to come at sacrifices to other earbud qualities. The diameter of the coupling element inserted into the ear may be too small or large, the element may be too short or angled incorrectly to match the user's ear topology. Ear couplers may be designed to be intentionally too large such as the foam plug or mushroom-cap tips to create a more complete seal and to resist falling out with motion. The oversized ear tips place a high pressure against the ear canal flesh and quickly become uncomfortable. Some models are designed with uncomfortable, non-customizable stabilizers or ear hangars in an attempt to take the weight of the earbud off the ear canal and improve stability; users commonly choose from a range of differently sized foam or mushroom-cap ear tips. Modifications of the length, direction, and curvature of the ear tips or overall custom fits are not available options to the general earbud consumer. While many earbuds are advertised as providing sound isolation, none are marketed for their ability to provide the user environmental awareness, and further none provide directionality-sensitivity. This creates a safety problem wherein the user is unable to hear warning sounds, other people, or other audible indications of impending harm.

The original in-ear monitor (IEM) invented by Stephen Ambrose in the 1960's and used for performances by musicians was the precursor for modern earbuds. IEMs tend to have customized, molded couplers that exactly fit performers' ears to attain the highest degree of isolation. These IEMs are uncomfortable in as much as the ear mold materials are rigid, fit tightly and do not flex with normal jaw motions; create very high levels of occlusion; and are unattractive as they tend to fill the visible ear canal with a vaguely flesh-colored plastic or silicon. An early version of Mr. Ambrose's IEM functioned as a portable listening device, a hearing aid and as functional jewelry [U.S. Pat. No. 4,852,177; 1989]. It employed a secondary acoustic path that vented pressures on the ear to a correct location in the earphone and prohibited a feedback cycle with the microphone that passed environmental sound into the sealed ear. These IEMs contributed less to hearing loss through this patented method by partially mitigating the pneumatic effects of sound constrained within the relatively small, trapped volumes of the sealed ear canal.

Most components that comprise conventional earbuds, whether they are custom-made or commercial, off-the-shelf products are not modifiable by the user. The user must choose at the time of purchase the set of earbud appearance, fit, quality and sound isolation that they are able to buy. Any desired variations require the purchase of another pair of earbuds.

Current Bluetooth connected earbuds are limited in both power and resolution. Bluetooth technology passes a low-resolution, compressed, digitized signal that degrades both the temporal resolution and the dynamic range of streamed music. Its receiver system can be a heavy user of power that requires frequent recharging. Many manufacturers opt to use a lower power version to minimize user frustrations but that comes at the cost of even less power for speaker operations. Speakers are then chosen that can only operate within remaining power budget, which further reduces the potential dynamic range of music.

Sound pressure levels of amplified live musical performances are commonly set at excessive volumes in an effort to produce a sensational experience for attendees. Because of the need for the sound emanating from speakers placed at the front of the stage to be loud enough to reach audiences in the back of the venue, attendees located closer to the stage are often subjected to deafening volumes for many hours. Such overstimulation triggers TTS (Temporary Threshold Shift wherein the listener's hearing sensitivity is involuntarily reduced) amongst the attendees, which then demands louder volumes to create the same sensation.

A resultant cacophony of competing sound sources further escalates these amplified sound pressure levels. In addition to highly amplified stage volumes, crowd noise, pyro technical explosions, etc., concert-goers also experience significant levels of physically transduced sounds (vibrations that impact and pass through the body).

These competing sound sources reflect off the walls, ceilings or other surfaces containing or surrounding the venue. In an attempt to cut through this confusion, amplified volumes are often pushed even louder.

In Ear Monitors were invented by Stephen Ambrose in 1965 and developed in the 70s with the help of Stevie Wonder to allow performers to hear their own music on stage and isolate away the competing sounds with the same quality they enjoy when using headphones in recording studios.

However, because these devices can create pneumatic pressures which trigger the acoustic or stapedius reflex and add the booming occlusion affect one's voice and music, they tend to subject the performers to excessive in-ear volume levels and must be dislodged or removed in order to hear ambient sounds. They are usually embodied in ear molds, which are uncomfortable and look unattractive. The isolation they offer is not optimum for all situations.

Auditory damage to both the performer's and the attendee's hearing caused by excessive volumes at musical events is well understood and documented. Civic regulations on noise pollution, timings and locations of events are continuing to limit venue opportunities for hosting a full-featured musical performance.

Currently available earbuds have limited ability to mitigate the excessive noise levels of amplified musical events. On the contrary, they tend to add their own inherently excessive listening levels to the excessive volumes present at the amplified even, thereby compounding the risk of hearing loss.

Conventional hearing protectors muffle the sound, are uncomfortable and can create excessive in-ear pressures. Additionally, occupants of areas neighboring a venue cannot practically or ethically be required to wear hearing protection devices.

Conventional in ear monitors do not allow an adjustable mixture of both the ambient and the electronically broadcast renditions of their performance. Often performers can be seen wearing only one IEM or hanging the other over their shoulder in order to hear their surrounding environment.

When worn out in the audience, IEMs sound far better than the over-amplified concert despite not being synchronized with the amplified sound coming off the stage. However, the further one is from the stage, the greater the lag between the broadcast sound and the amplified sound emanating from the stage speakers.

The capability of synchronizing these two sound sources and allowing for user-adjustable volumes and mixtures between the two (as allowed by the novel invention described herein) has not been possible before now.

Prior attempts at broadcast performances used a single broadcast source using radio transmissions and timing delays were incurred by the difference in the speed of sound (live music) versus the speed of light (radio transmissions). In a large enough venue, attendees receive the radio transmission before the live music reached them, which creates an untenable timing gap.

Conventional earbuds degrade and muffle the amplified concert sound as well as the broadcast in-ear speaker sound due to occlusion, speaker impedance mismatch with the tympanic membrane and the aforementioned and resultant over-stimulation of the acoustic reflex. This creates a disruptive quality gap when trying to simultaneously listen to a broadcast and a live performance. Excessive volumes of both audio sources are additive and the risk of hearing loss is increased even further.

Amplitude-based compression algorithms that limit the dynamic (soft to loud) range of sounds produced from an audio system are commonly available. One example applies to television ads. The creators or broadcasters of television advertisements often use amplitude based dynamic range compression to set the overall audio volume of their advertisements at a higher level than the programs within which they're aired to draw viewers' attention to them. Counteracting software exists that reduces those sound volumes back in line with the programs. Similar sound reduction software algorithms, which are generally known as digital dynamic range compression, are applied to audio systems, MP3 players and smartphones for listening to music more safely.

These existing algorithms are amplitude-based and are set at ratios of sound level volumes relative to the threshold of the maximum volume level that the manufacturer deems safe or the listener chooses to hear.

Problems arise from the variation in the efficiency of sound transmission and hearing sensitivity across the audible frequency range. Bass sounds displace much more air than mid-range sounds to produce the same apparent loudness to the listener (FIG. 8, Graphic 1). Digital compression algorithms usually apply uniform loudness factor caps across all frequencies, for example, at 60 phons, which still permit nearly 300,000 times the displacement of air between 30 Hz at the compression cap and 3 kHz at the threshold of hearing. The sound level threshold of pain is; however, flatter than the threshold of hearing, which places audible bass sounds much closer to the pain limit than mid-range sounds. In a sealed ear canal, the pain threshold level is even lower, particularly in the bass, causing even more damage. The Occupational Safety and Health Administration (OSHA) begins requiring hearing protection at 85 dB of workplace environmental noise as prolonged exposure at that level can cause long-term damage. Early study results indicate that within a sealed ear, hearing damage begins as low as at 60 dB. An amplitude-based digital compression algorithm is too coarse a tool to adequately protect a listener's hearing.

In conclusion, no conventional earbud design to date is able to satisfactorily

1. Protect the listener's hearing from in-ear displacement based pneumatic pressures while delivering optimum, user adjustable sound quality, isolation, and ambient sound perception and directionality-sensitivity at the user's desired levels;
2. Fit each user perfectly;
3. Range in aesthetic properties from purely functional to unique, high-end customized jewelry;
4. Be fully modular to meet the servicing, fit, acoustic and aesthetic needs of the user at any point in time;
5. Provide high-fidelity audio with a stable, wireless signal;
6. Satisfactorily and variably mitigate the excessive sound levels of musical performances
7. And no existing digital compression algorithm adequately protects a listener from harmful levels of sound.

Likewise, no existing in-ear-monitor 1. allow an adjustable isolation from ambient sounds nor
2. permit an adjustable mixture of both the ambient and the electronically broadcast renditions of their performance.

SUMMARY OF THE INVENTION

The invention, an improved earbud, has a fully modular set of parts that of primary importance includes membranes and variable vents which protect the listener's hearing while improving the quality and isolation of sound according to the user's desired characteristics whether wired or wireless and through its modularity, can achieve a uniquely personal fit and act as a visual vehicle of personal statement as well as drastically diminish the noise pollution of musical events and works with an improved, displacement-based digital compression algorithm. The membranes described herein may be a flexible compliant member as described in U.S. Pat. No. 8,774,435, the entire content of which is hereby incorporated by reference.

The variable vents, the membranes and speakers all dilute harmful pneumatic pressures off the eardrum and the speaker while the membranes maintain an acoustic seal necessary for the highest fidelity sound. A user can create their desired sound profile through end cap, speaker and filter hardware as well as venting configuration choices. A user can adjust for ambient sounds and achieve directionality-sensitivity of environmental audio signals through a second embodiment of the Ambrose Earbud.

The invention can be used in the passive mode (i.e. —the earbud is worn as normal in the ear but the speaker is not powered on) as a hearing protection device by closing the vents to the desired amount or similarly with an alternative and simpler embodiment, which has no speaker.

All parts of the improved earbud invention are fully modular and easily snap together and apart for easy assembly and user-driven interchangeability to suit listener preferences. The cochlea of most humans is located behind the eyes, however, the external ear and ear canal pathway geometries vary wildly from person to person. The Ambrose Earbud parts have a range of shapes and sizes to create the perfect fit and all parts rotate without limit about their intersections enabling a user to choose the height and directionality of the ear horn fit with their ear as well as the weight balance, separation, and venting of the earbuds. Licensed end-cap customizers will be able to create versions that are visually unique such as high-end jewelry or political statements and have precisely defined acoustic resonance profiles.

The connectivity of the improved earbud will also be modular. User's can choose a traditionally corded version, a Bluetooth version with the Bluetooth receiver on a cord between the earbuds or a fully wireless model, which has the Bluetooth receiver within the earbud housing as an additional layer. User's can switch between the connectivity options by screwing the relevant cable in to or out from the bottom of the earbud housing, which also has a spring contact plate. With the fully wireless options, user's can screw in an antenna that curls around the outer ear, improves the stability and range of the Bluetooth signal and acts as an earbud stabilizer. Connectivity through the audio cable provides the highest quality sound and the lowest price but many users find cables to be cumbersome as they are easily tangled and caught. The Ambrose earbuds will have high quality speakers at even the entry level despite power and resolution limits presented by Bluetooth connectivity. With better speakers than are normally paired to Bluetooth receivers, the sound quality passed to the user becomes the maximum possible with Bluetooth rather than further diminished. The Bluetooth receiver fob on the cable that only connects to the earbuds provides a mid-level dynamic range to the sound quality and cost to the user as the fob can hold a larger battery and thus provides a higher power budget for both the signal and speaker. While the earbud to earbud cable is less cumbersome than the traditional audio cable, many users desire a fully wireless design. The fully wireless design provides a maximum of physical freedom to the user and, with the entirety of the Ambrose Earbud technology, will provide the highest sound quality and dynamic range of any available Bluetooth earbud.

The Ambrose Earbud is the key element in reducing music performance sound levels while maintaining the high quality sensory experience of attendance. Musical events will be restructured to separate the transduced and acoustic effects of loud sound through vibration projection and the broadcasting of an event's music to Ambrose Earbud-connected audio devices. Infrasound frequencies (those with frequencies below standard human hearing) will be projected against venue walls and into the attending crowd to create the transduced vibrations that energize an audience.

The performed music will not be amplified but instead be broadcast to each audience member's portable music device such as a music-enabled mobile phone. The attendee will connect to the venue's broadcast system and the broadcast sound will be synchronized to the live sound via a number of possible methods. By keeping track of an attendee's location, the broadcast system can control the release timing of a signal to their device to match the arrival of the live sound. A position-based delayed sound will keep track of the attendee's location through such methods as Global Positioning System (GPS), Wi-Fi triangulation, or user-indicated seat position. An application-based synchronization will quickly compare the arrival time of the live sound detected by the user's device microphone and generate the necessary time delay for the broadcast sound. The synchronization program can continuously correct the offset for an attendee that is moving through a venue. The broadcast sound will be processed according to the timing delay and optionally, the geometric acoustic response of the venue at that location. The shapes and materials of the walls, ceiling, floor and other structural elements all reflect and slightly alter the music in unique ways so that the music in one location, a corner for example, sounds notably different from that in the center of the main open space.

The attendee will be wearing the Ambrose Earbud and listening to their own, user-specific broadcast sound. The sound quality will not be diminished because the membranes respond quickly and uniformly to all frequencies, which maintains the crispness and precise tones of the performance. Performers will be listening to the Ambrose Earbud embodiment of in-ear monitors modified with the Ambrose Tunable Impedance-Matching Acoustic Transformer for the human ears based on bio-mimicry. Performers will be able to select their desired isolation or passage of ambient sound through the Transformer's secondary Eustachian tube. An ADEL membrane, as in other embodiments, acts as a second tympanic membrane and damps both external and streamed sounds, which can optionally be a broadcast of their own music at any location within the venue. Performer personalities, special effects and the shared energy of a crowd will still complete the musical event experience, sound quality and hearing safety will be improved and noise pollution minimized.

A displacement-based digital compression algorithm places a cap on sound output at a given frequency that is consistent with both the maximum safe air displacement within a sealed ear canal and the comfortable maximum loudness (in phons) for that frequency. When used in conjunction with an Ambrose Earbud, sound quality is maintained at all frequencies because the membrane responds uniformly well across the spectrum.

The advantages of the invention are to provide a safer and higher quality listening and sound isolation experience, ambient sound perception, improved comfort, and the new ability to fully customize the sound, fit and aesthetics of an earbud as well as the ability to remove excess sound levels from live music events while improving the listening experience and to process the sound output with a digital compression algorithm that is displacement-and-loudness-based per frequency to further protect listener hearing health. The anticipated usage of the Ambrose Earbud includes listening to personal audio devices such as music players and telephones; in loud environments where a reduced but clear sound is desired such as at a rock concert; and for situations that require total sound isolation such as while operating a jackhammer or for musicians while performing on stage.

BRIEF DESCRIPTION OF THE DRAWINGS

FIG. 2, comprising FIG. 2A shows the front end cap rotated so that the ear horn intersection is in the upper left quadrant while the ear horn is rotated downward; and FIG. 2B shows the front end cap rotated so that the ear horn intersection is in the lower left quadrant while the ear horn is rotated upward.

FIG. 3, comprising FIG. 2A shows the audio cable directed upwardly and FIG. 2B shows the audio cable directed downwardly.

FIG. 4, comprising FIGS. 4A, 4B and 4C shows the embodiment A1 with the back end cap rotated in different positions to show venting options; wherein FIG. 4A shows the closed position, FIG. 4B shows the open position and FIG. 4C shows the partially open position.

FIG. 5 is an exploded view of the A1 embodiment.

FIG. 6 shows the A1 embodiment with jeweling embellishment.

FIG. 7, comprising FIGS. 7A, 7B and 7C shows different audio signal connectivity options for the A1 embodiment.

FIG. 10, comprising FIGS. 10A, 10B and 10C shows the inner top basket of FIG. 9 rotated to different positions to show the top venting options; wherein, FIG. 10A shows the open position, FIG. 10B shows the partially opened position and FIG. 10C shows the closed position.

FIG. 11, comprising FIGS. 11A, 11B and 11C shows the A2 embodiment with the inner side basket rotated to different positions to show the venting options, wherein FIG. 11A shows the open position, FIG. 11B shows the partially opened position and FIG. 11C shows the closed position.

FIG. 12 is an exploded view of the A2 embodiment.

FIG. 13, comprising FIGS. 13A and 13B shows a turnable impedance matching acoustic transformer embodiment (A3), wherein FIG. 13A shows the transformer fully assembled and FIG. 13B shows the transformer as intergrated into an ear-monitor that is being manipulated while worn.

FIG. 14, including FIGS. 14A, 14B, 14C and 14D shows the embodiment (A3) at multiple positions to demonstrate the venting options, wherein FIG. 13A is the fully closed position, FIG. 14B is a mostly closed position, FIG. 14C is a mostly opened position and FIG. 14D is a fully opened position.

DETAILED DESCRIPTION OF THE PREFERRED EMBODIMENTS

Figure 1:
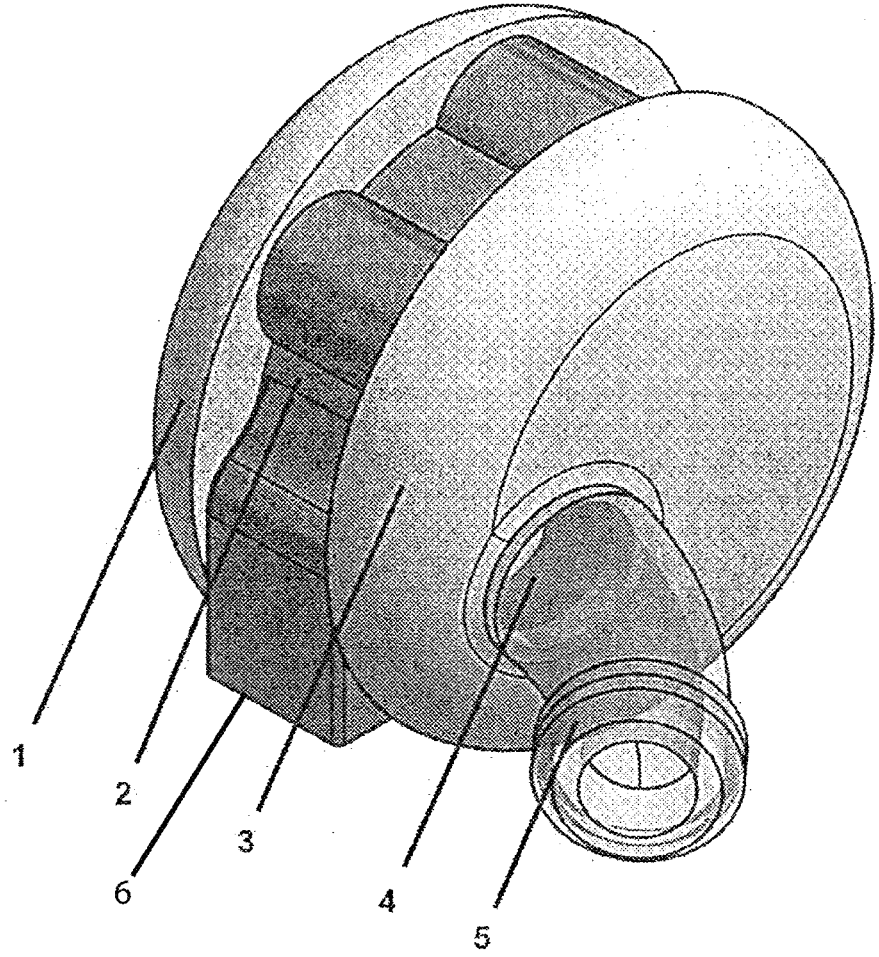
FIG. 1 is perspective view of a first embodiment of the invention (A1) fully assembled.

FIG. 1 is a the view of the fully assembled, closed Ambrose Earbud, primary embodiment, which will be referred to as A1. Visible portions include the front end cap 3 and the back end cap 1, the central control unit 2 with the cable port 6 and the arcs that enclose the vent channels 10, the ear horn 4 and ear tip 5.

The ear tip 5 snaps into the ear horn 4 which snaps into the front end cap 3. The ear horn 4 rotates about its intersection with the front end cap 3 and the end cap 3 rotates relative to the central control unit 2 to attain the user's desired ear horn position. The ear horn 4 is formed of a firm material such as a hard plastic and is not intended to be visible, however, a user can choose to customize its appearance. The ear horn 4 is shown in FIG. 1 with a moderate curvature and length. Straighter and more curved, shorter and longer versions can be selected by the user to optimize the fit into their own ear canal. The ear tip 5 shown in FIG. 1 is of a mushroom-cap style of moderate size, is available on the market in a range of sizes and is made of a semi-firm material such as rubber, silicon or semi-firm plastic to form a seal with the ear canal. An alternative ear tip 5 which will also snap onto the ear horn 4 is the ADEL. Both the mushroom-cap style and the ADEL ear tips 5 are circularly symmetric and fit through compliance with the ear canal. The ear tip 5 can be rotated about its intersection with the ear horn 4, but to no additional variation in function.

The front end cap 3 snaps into the central control unit 2 which then snaps into the back end cap 1 and the interior volume of these three parts contain the parts depicted subsequently in FIG. 5. The back 1 and front 3 end caps are formed from firm materials such as metal, wood or hard plastic. The end caps 1,3 can host a range of appearances from functional to custom high end jewelry to individual statement through choices of materials, colors, polish, embellishments, and designs. The shape of the end cap 1,3 intersections must be circular to maintain the ability to intersect and rotate relative to the other components, however, the outside of the end cap can vary in shape and mass profile to provide the user their desired resonance characteristics. The dimensions of the end caps 1,3 are chosen to meet the size of the user's intertragical notch of the pinna (the dip in the exterior portion of the ear prior to the ear canal) and the central control unit 2 and interior element (FIG. 5) selections must be scaled to match the end caps' size. The back end cap and central control unit rotate relative to each other to achieve the desired cable position of cable 7 and back end cap vent position 12. Likewise, the central control unit 2 and front end cap 3 rotate relative to each other for the same purposes as well as to further improve the comfort of the earbud by allowing the ear horn to have an initial position appropriate for the user's personal ear geometry and which is described in greater detail subsequently.

Figure 2A:
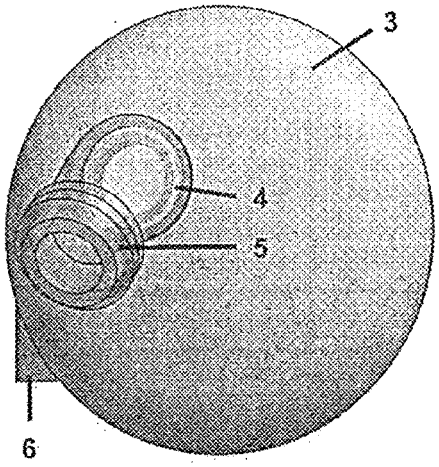
FIGS. 2A and 2B, shows embodiment A1 with the ear horn and front end cap rotated in two different positions.
Figure 2B:
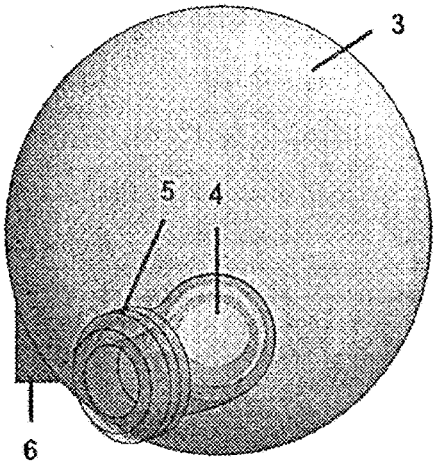

FIG. 2 exemplifies two different positionings within the A1 for the front end cap 3 and ear horn 4 with respect to a stably positioned cable port 6, which is oriented so that the audio cable 7 would hang downward. The rotation of the front end cap 3 makes it possible for the ear horn intersection to match the height of the ear canal entrance within the intertragical notch and the rotation of the ear horn 4 causes the angle of the ear horn 4 to match the angle of the ear canal. Visible elements in FIG. 2 are the front end cap 3, the ear horn 4, the ear tip 5 and the cable port 6. In FIG. 2A, the front end cap 3 is rotated about its intersection with the central control unit 2 so that its intersection with the ear horn 4 is at about 300°, which raises it about five-eighths of the front end cap's 3 diameter above the bottom of the intertragical notch. The ear horn 4 is rotated about its intersection with the front end cap 3 so that it is directed mostly downward at about 200°. In FIG. 2B, the front end cap 3 is rotated so that the ear horn 4 intersection is at the bottom, or 180° and the ear horn 4 is rotated mostly leftward or about 260°.

Figure 3A:
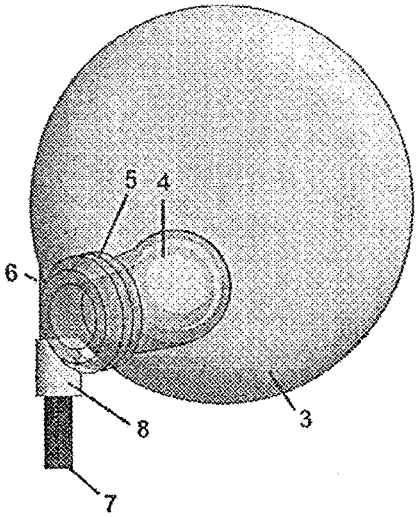
FIGS. 3A and 3B shows the A1 embodiment with an audio cable rotated in different positions with respect to the stationary ear horn and front end cap.
Figure 3B:
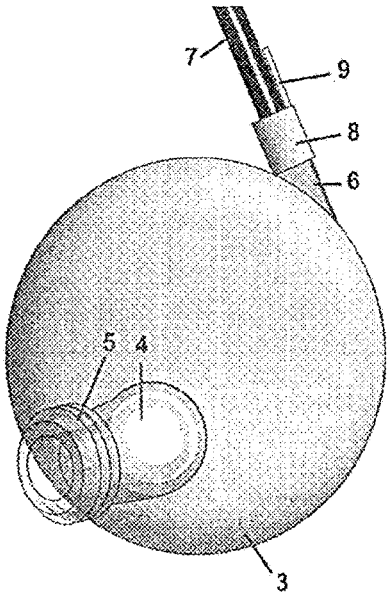

FIG. 3 depicts the A1 with the audio cable 7 rotated to two different positions relative to a stably positioned front end cap 3 and ear 4 horn and also shows the use of the optional 9 ear hangar wire 9. In FIG. 3A, the audio cable 7 hangs directly down from the Ambrose Earbud. In this position, it is anticipated that the ear horn 4 and ear tip 5 are deeply seated within the ear canal to maintain stable placement. In FIG. 3B, the audio cable 7 is positioned mostly upward and the optional ear hangar wire 9 is inserted into the cable strain protector sleeve 8. The cable strain protector sleeve 8 and ear hangar wire 9 are not depicted to scale but rather are both long enough to reach over to the back of most user's ears. The ear hangar wire is shaped over the ear by the user to match their unique ear geometry and, because it is in the same cable strain protector sleeve 8 as the audio cable 7, the audio cable 7 will also wrap over the user's ear. This configuration provides a stable placement of the earbud within the ear and reduces the weight and pressure stress on the ear canal. With the ear hangar 9 taking the weight of the earbud, the earbuds can be worn at a shallower position, which widens the distance between them and therefore also widens the stereo image of the sound source.

FIG. 4 demonstrates the different venting options available within the A1 by rotating the back end cap 1 relative to a stably positioned central control unit 2. The visible parts of the earbud in FIG. 4 are: the back end cap 1; the central control unit 2; the audio cable port 6; the vent channels 10 on the perimeter of the central control unit 2; the back, full-sized membrane 11; and the vent 12 of the back end cap 1. When the A1 is fully assembled, the vent channels 10 of the central control unit 2 are compression sealed between the back and front end caps. The back membrane 11 provides one part of the acoustic seal for the ear canal. A volume of space exists between the back membrane 11 and back end cap 1 which can be sealed, vented or partially vented according to the user's desires.

In FIG. 4A, the back end cap 1 is rotated so that the vent 12 is completely aligned with the vent channels 10. In this position, the back end cap 1 volume of space is not vented to the outside, barometric pressure air. The back volume of space may be (1) pneumatically sealed, (2) vented fully into the front volume of space, (3) partially vented indirectly through the front volume to the outside, or (4) sealed while the front end cap 3 is fully open to the outside if the front end cap 3 is rotated so that its vent 12 is aligned with a different ent channel 10, the same vent channel 10, partially aligned with the same vent channel 10, or aligned fully away from any vent channels, respectively.

(1) A full seal provides isolation from exterior sounds for the user with a passive speaker. An active speaker will experience a high degree of impedance as it is trying to compress the initial volume of air into a smaller amount of space. The speaker will move slowly and not as far as it is directed to do by the power signal at audio cable 7. This reduces and blurs all sounds the speaker is intended to produce but especially affects the perceived bass sounds as the tympanic membrane is least sensitive to low spectral sounds and requires the highest amplitudes to produce the same perceived sound level. The membrane can do little to minimize the pneumatic pressures as it is contained within the same pressure environment.

(2) When the back volume is vented to the front volume (mutual venting) and the earbud is passive, a user will achieve a similar isolation to when both volumes are sealed and not vented to each other. The benefit of mutual venting is that it reduces the occlusion effect. When occlusion sounds occur, the pneumatic pressures reflect off and transmit through the membranes and speaker (acting as a membrane while passive) and the pressures can oscillate between the back, front and ear canal volumes, diluting the strength of the pneumatic pressures with each membrane interaction. If the user chooses to power the speaker—listen to something—with mutual sealed venting, the speaker becomes directional and the sound emitted through the back volume cancels those emitted through the front volume.

(3) An indirect, partial venting of the back volume through the front volume provides more isolation from exterior sounds than the same amount of direct, partial venting. Likewise, the speaker's impedance is reduced a small amount on the backwards motion while more is reduced in the frontwards motion. Both the exterior and the active speaker's sounds are amplified in the mid and high frequencies because the volume that is open—the front membrane and end cap-enclosed space—is smaller than that of the back as well as due to the doppler effect of the speaker relative to the tympanic membrane, which makes approaching sounds higher pitched and receding sounds lower.

(4) A sealed back volume with an open front volume will produce the highest impedance on the active speaker's backward motion with the least on its forward motion. Exterior and active speaker sounds will be crisp and strong in the mid and high frequencies while quiet and muddled at the low end of the sound spectrum.

In FIG. 4B, the back volume is fully vented to the outside barometric air pressure. Exterior sounds are clearly and strongly audible yet still reduced compared to not wearing an earbud. The back membrane 11 responds quickly to the pneumatic changes induced by the moving speaker diaphragm, impedance is removed from the speaker's backward motion and crisp, clear bass sounds are generated. As with the sealed back vent status depicted in FIG. 4A, the vent status of the front chamber determines the clarity and strength of exterior and speaker sounds in the mid and high frequencies.

In FIG. 4C, the back volume is partially vented, which provides an intermediate amount of isolation, impedance reduction on the backward speaker motion, and bass volume and quality.

A parallel set of venting options exist for the front end cap 3 and the chamber enclosed by front membrane 19 with an additional set of pneumatic energy dilution, speaker impedance removal and isolation characteristics. The closed, open or partially open front venting choice reduce, strengthen or pass at an intermediate level the mid and high frequencies' clarity and strength. An open front vent provides the best individual stress relief for the tympanic membrane as the front membrane 19 is the most compliant surface within the ear canal volume. When both the back and front vents 12 are open, the pneumatic pressures created by the active speaker's acoustic signals are reduced the most through the pressure impedances of each vent, membrane and the speaker, maximally relieving the tympanic membrane of pneumatic stresses.

FIG. 5 is an exploded view of the A1 that shows all the internal parts and depicts its full modularity. Each intersection between parts is circular for rotation ability and has ridges and grooves to provide the method of connection, unless otherwise noted. Adjacent parts are manually pressured together, their ridges jump over each other and both come to rest in the opposing part's groove. The connections are firm, will not spontaneously fail, yet the parts can readily be snapped back apart under intentional, opposing pressure. The A1 is easy to assemble without the need for toxic glues and easy to service or exchange for alternative models of parts by either trained dealers or novice users.

From left, the back end cap 1 has a vent 12 and contains the back membrane 13 frame. The back membrane 11 rests inside the back membrane frame 13. The back membrane gasket 14 fits snugly inside the back membrane frame 13 and secures the back membrane 11 in place. The back membrane 11 acts as a sealed dividing wall to create a back chamber with the back end cap 1 and an ear canal chamber with the ear canal, tympanic membrane and the 19 front membrane 19. The back membrane 11 dilutes pneumatic pressures, provides an acoustic seal and maintains crisp, clear sound quality.

The back membrane-to-speaker spacer 15 and speaker frame rests against the back membrane frame 13. The back spacer-frame 15 holds the speaker in the correct location 21 and has an open notch to allow the audio cable 7 to pass through, connect and power the speaker. The speaker front gasket 16 secures the speaker's position and is contained within the back spacer-frame 15. The back spacer-frame 15 sits inside the central control unit 2 and fills most of its depth. The speaker front spacer 17 reinforces the speaker's position 21 and also sits inside the central control unit 2, filling the rest of its depth.

The front membrane-to-speaker frame 18 fits inside the front end cap 3 and has an orifice that allows sound to pass from the speaker, through the intersection orifice 22 of the front end cap 3 with the ear horn 4, the ear horn 4 itself, the ear tip 5, and the ear canal to finally reach the tympanic membrane. The front membrane 19 rests inside the front membrane-to-speaker frame 18 across the membrane orifice depicted as a bean shape. The front membrane-to-end cap frame 20 fits snugly inside the membrane orifice and secures the front membrane 19. The front end cap 3 has cavities to receive pins on the front membrane-to-speaker frame 18 that secure the two elements together in an orientation that enables the front membrane 19 to form a pneumatic pressure release chamber with the front end cap 3 with access to its variable vent 12. As with the back membrane 11, the front membrane 19 dilutes pneumatic pressures, provides an acoustic seal and maintains crisp, clear sound quality.

At the intersection 22 between the front end cap 3 and the ear horn 4, a metal mesh disk can be placed, which is used to filter pitches according to the user's preference. Smaller mesh spacings of a typical rectilinear pattern preferentially pass higher pitched sounds and larger spacings, lower frequency sounds. Customized sound filter disks can have a mixture of spacing sizes and shapes not limited to rectilinear patterns that provide a more nuanced filtering function across the sound spectrum.

Not shown in FIG. 5 is the audio cable assembly 7. The audio cable 7 terminates with a power-transferring tip. The tip has pressure-connection coils. The tip is inserted into the cable port 6 of the central control unit 2 and the coils are mated to grooves within the cable port 6. The grooves and the pressure-connection coils place the tip firmly and stably in the correct position to allow the tip to transfer power to the speaker. The cable strain protection sleeve 8 is slipped over the cable and typically is located against the cable port 6. The cable sleeve 8 is not fixed to the audio cable 7 but through the friction between the rubberized surface of the audio cable 7 and its own material, it maintains its location until the user moves it to a preferred position. The optional ear hangar wire 9 is a slim piece of rubber-coated metal that is wide enough to have a reasonable lifetime and long enough to form a comfortable and stable shape over most users' ears. The ear hangar 9 fits into the cable sleeve 8 and carries the audio cable 7 over the user's ear.

FIG. 6 shows the A1 with an enhancement 23 that transforms it from a simple listening device to a piece of jewelry. The back and front end caps as well as the central control unit 2 can be formed of customized materials and colors to create a desired visual effect. The back end cap 1 can also be visually embellished with features such as different bell shapes, carvings, filigrees, and precious stones.

FIG. 7 shows the A1 with signal connectivity options. In FIG. 7A, the audio cable 7 connects to the earbud via the screw-in cable connector 24, which mates to a spring-plate contact to pass signal. The audio cable 7 connects to an audio device using a standard 3.5 mm headphone jack 25. In FIG. 7B, audio signals are sent wirelessly to a Bluetooth receiver 26 on a cable. This cable connects to both earbuds in the same manner as 7A but is free of physical connection to an audio source device. In FIG. 7C, the Bluetooth receiver is housed within one earbud and sends a stereo signal via FM to the other earbud. An optional earbud stabilizer 27 acts as an antenna that further stabilizes the Bluetooth signal and improves the possible range from the audio device. The signal connectivity options can identically be used with the second Ambrose Earbud embodiment, A2.

Figure 8:
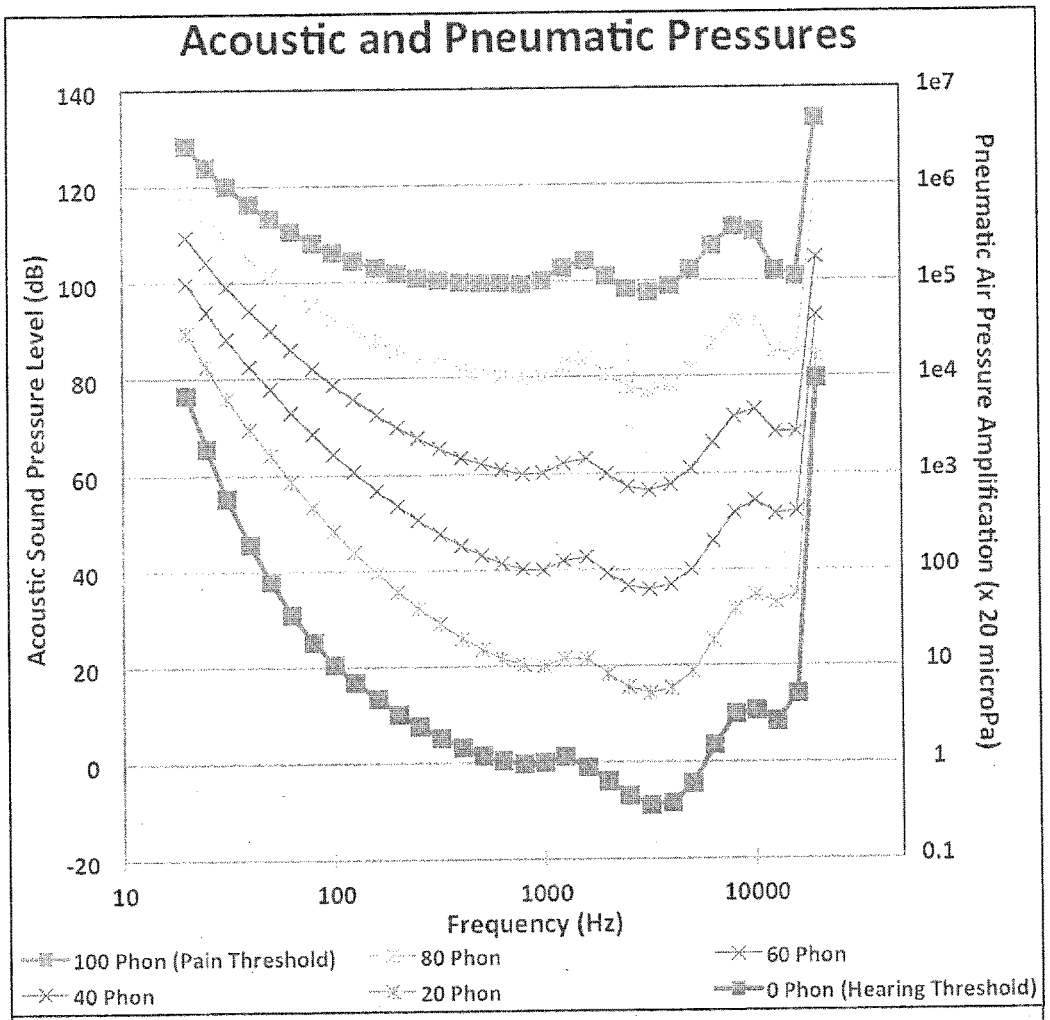
FIG. 8, is an example of a combined pneumatic air displacement and relative loudness based digital compression spectrum.

FIG. 8 demonstrates an example combined displacement-and-loudness-based digital compression upper limit spectrum (heavy, solid line) in comparison to equal loudness curves at 0, 40, 60, and 100 phons (data points). Here, the example upper limit is set at the minimum of 55 phons or 55 dB (or 600 times the air displacement at 1 kHz and 0 phon). Volumes are capped at 55 dB except in the mid-range where the perceived loudness would be too high in comparison.

Figure 9:
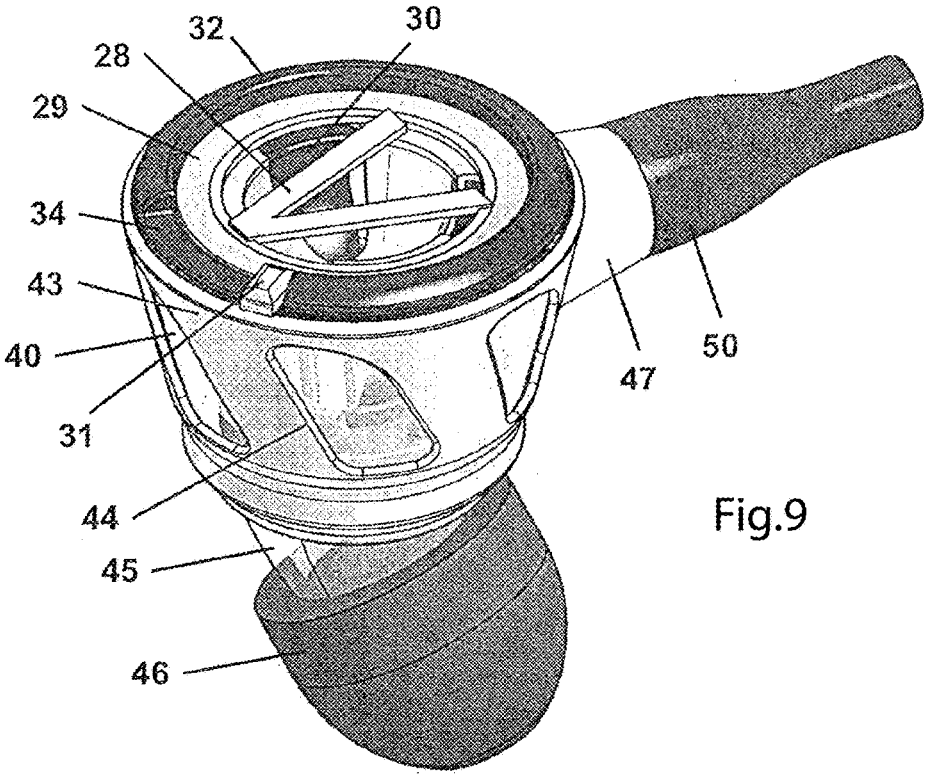
FIG. 9 is a perspective view of a second embodiment (A2), fully assembled.

FIG. 9 is the view of the fully assembled, closed Ambrose Earbud, secondary embodiment with directionality sensitivity of ambient sound, which will be referred to as A2. Many elements are visible. The open end cap 28 sits with a snap-fit connection on top of the top vent, exterior basket 29, which has one of its top vent, exterior basket, vents 30 visible. The top vent, exterior basket 29 sits inside the top vent, interior basket 32 with a relative position (and thus venting status) controlled with the top vent, exterior basket, positioning handle 31, which slides within the top vent, interior basket, positioning handle seat arc 34. The top vent, interior basket 32 fits with a snap-fit connection inside the side vent, interior basket 40, which is likewise fit within the side vent, exterior basket 43. Three of the side vent, exterior basket, vents 44 are visible. The side vent, interior basket 40 snap-fit connects to the ear horn 45, which is likewise fit to the ear tip 46. The cable port 47 on the side of the side vent, exterior basket 43 is connected to the cable protector sleeve 50 through internal elements.

Figure 10A:
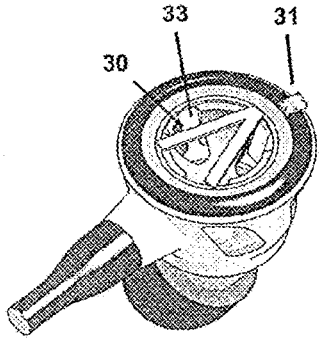
Figure 10B:
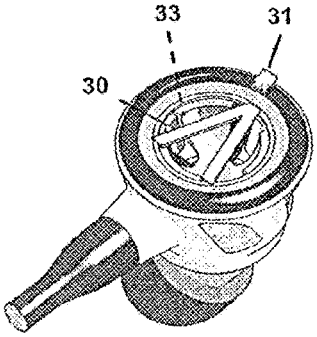
Figure 10C:
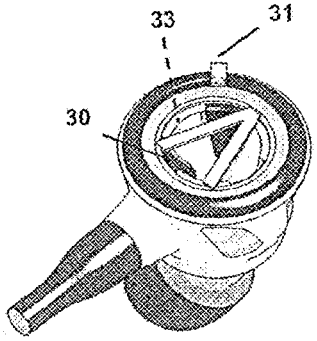

FIG. 10 demonstrates the adjustability of the top vents of the A2. In FIG. 10A, the top vents of the A2 are open. The top vent, exterior basket, positioning handle 31 is set in the far right position. The top vent, exterior basket, vents 30 are aligned with the top vent, interior basket, vents 33 to provide access to the outside air. This maximizes the dampening of excess pneumatic pressures through the minimum impedance on the ADEL membrane 37 and allows the user to most clearly hear ambient sounds from a narrow cone of relative positions to the user. In FIG. 10B, the top vents of the A2 are partially open. The handle 31 is set in the middle position. The top vent, exterior basket, vents 30 are partially aligned with the top vent, interior basket, vents 33 to provide medium access to the outside air. This provides an intermediate level of pneumatic pressure dampening and a reduced level of ambient sound from a narrow cone of a user's relative position relative to the open position. In FIG. 10C, the top vents of the A2 are fully closed. The handle 31 is set in the far left position. The top vent, exterior basket, vents 30 are anti-aligned with the top vent, interior basket, vents 33 to provide no access to the outside air and maximum isolation from ambient sounds in the narrow position cone. The ADEL membrane 37 experiences high impedance and is in a lowered state of pressure damping.

FIG. 11 demonstrates the adjustability of the side vents of the A2, similar to that of the top vents. In FIG. 11A, the side vents of the A2 are open. The side vent, exterior basket, vents 44 are aligned with the side vent, interior basket, vents 41 to provide access to the outside air. This maximizes the dampening of excess pneumatic pressures through the minimum impedance on the ADEL membrane 37 and allows the user to most clearly hear ambient sounds from a wide cone of relative positions to the user. In FIG. 11B, the side vents of the A2 are partially open. The side vent, exterior basket, vents 44 are partially aligned with the side vent, interior basket, vents 41 to provide medium access to the outside air. This provides an intermediate level of pneumatic pressure dampening and a reduced level of ambient sound from a narrow cone of a user's relative position relative to the open position. In FIG. 11C, the side vents of the A2 are fully closed. The side vent, exterior basket, vents 44 are anti-aligned with the 41 side vent, interior basket, vents 41 to provide no access to the outside air and maximum isolation from ambient sounds in the wide position cone. The ADEL membrane 37 experiences high impedance and is in a lowered state of pressure damping. The ADEL membrane 37 experiences the least overall impedance and can dampen the greatest amount of excess pneumatic pressures off the tympanic membrane when both the top and side vents are fully open and the opposite is true when both the top and side vents are fully closed.

FIG. 12 is an exploded view of the A2. Multiple transducers 35 (speakers and amplifiers) are used to maximize the fidelity of the sound going into the earbud. Each of the transducers 35 can focus on a narrow-band section of the frequency spectrum to produce higher quality sound than a single transducer that attempts to cover a full spectrum of sound. The transducers 35 are fitted onto the transducers seats 39 on the spacer and transducer positioner 38. They are held in place by the transducer positioning couplers 36. The ADEL membrane 37 and frame is snap-fitted into the spacer and transducer positioner 38. The ADEL membrane 37 is placed between two circular frames and the three elements are firmly fixed through a press-fit. The ADEL membrane provides an acoustic seal for the ear canal, which prevents sound drop-out, particularly in the bass yet through its compliance, it dampens the energy of the pneumatic pressures associated with sound. The ADEL membrane is able to damp the most pressure (most compliant; experiences the least impedance) when the side opposite the sound pressure has access to the barometric air pressure. For A2, two sets of basket-shaped multi-vents are used to provide the user the ability to identify the direction of an ambient sound (360 degrees, narrow and wide cones of position) while using the A2 for improved personal safety and communications. The top vent baskets are located above the transducers 35. Anopen end cap 28 with a logo snap-fits into the top vent, exterior basket 29. The pair similarly goes into the top vent, interior basket 32, which is then snap-fitted above the side vent, interior basket 40 and into the side vent, exterior basket 43. The side vent, interior basket 40 snap-fit connects to the ear horn 45, which is likewise fit to the ear tip 46. On the side of the side vent, exterior basket 43 is the cable port 47 through which the transducers 35 receive power. The side vent, interior basket 40 has a side vent, interior basket cable access sliding window. As the side vent, interior basket 40 is rotated relative to the side vent, exterior basket 43 between venting positions, the audio power cable pathway is not disrupted. The audio cable pressure-connector 48 fits inside the cable port 47 and the power-transferring cable tip 49 is snap-fitted inside of it. The cable protector sleeve 50 wraps around the power-transferring cable tip 49 and the end of the audio cable. The ear tip 46 snap-fits onto the end of the ear horn 45, which in turn snap-fits into the bottom of the side vent, exterior basket 43. The ear tip 46 fits into the user's ear such that a seal is completed.

FIG. 13A is the view of the fully assembled, closed Ambrose Tunable Impedance Matched Acoustic Transformer, third Ambrose Earbud embodiment to be used as a modification to In-Ear-Monitors, which will be referred to as A3. Most elements are visible. The Controller 51 is connected to the rest of the system through parts not visible in this view. The ambient vent 52 is pressure-fitted onto the top of the adjustable secondary eustachian tube 53, which forms the main A3 shape and contains the majority of its parts. The adjustable valve 54 is a flexible cylinder trapped between the ambient vent 52 and the membrane tensioner 55. The membrane tensioner 55 has two sets of vents: the membrane tensioner, top vents 56 and the membrane tensioner, side vents 57. It travels up and down the inside of the adjustable valve 54 according to the adjustments of the controller 51 with a fully extended position that makes it touch the ADEL membrane 58. The membrane 58 is stretched across the ADEL membrane frame 60 and the pair is pressure-fitted into the end of the adjustable secondary eustachian tube 53 where it rests on the adjustable secondary eustachian tube, ADEL membrane seat 59. 13B demonstrates the scale of the A3. It is integrated into an In-Ear-Monitor and a user is adjusting the venting level by turning the controller 51. The A3 is placed in a tube that penetrates through the in-ear-monitor to the ear canal. The ambient vent 52 is flush with the exterior surface. The controller 51 is accessible to the user and the controller stem 61, which connects the controller 51 to all the internal parts, is visible.

FIG. 14 demonstrates the venting adjustability of the A3 in cross-sectional cut views. This view shows the controller 51 connected to the controller stem 61, which ends in the controller stem base 62. The base forms the center of the membrane tensioner 55 and the two parts are snap-fitted together. The adjustable valve 54 surrounds the controller stem 61. In FIG. 14A, the A3 is fully sealed to ambient sounds and air pressure. The controller 51 is rotated all the way outward, it has pulled the membrane tensioner 55 outward via the controller stem base 62 and the flexible material of the adjustable valve 54 is compressed to its maximum level such that it completely fills the radius of the adjustable secondary eustachian tube 53. In FIG. 14B, the A3 is mostly closed. The controller 51 is rotated partially inward, the membrane tensioner 55 is pushed partially inward, and the adjustable valve 54 is partially relaxed. In FIG. 14C, the A3 is mostly open. The controller 51 is rotated further inward, the membrane tensioner 55 is pushed further inward, and the adjustable valve 54 is mostly relaxed. In FIG. 14D, the A3 is fully open to ambient sounds and pressures. The controller 51 is rotated all the iway inward, the membrane tensioner 55 is pushed to its maximum position, and the adjustable valve 54 is fully relaxed. The membrane tensioner 55 is in contact with the ADEL membrane 58, which now has less but still some flexibility in the presence of pneumatic sound pressures. In the intermediate positions of 14B and 14C, the maximum pneumatic pressure dampening will occur as the ADEL membrane 58 has maximum flexibility and real-time pressure changes in the adjustable secondary eustachian tube can be exhausted through the ambient vent 52.

REFERENCED NUMERALS IN DRAWINGS

1. Back end cap
2. Central control unit
3. Front end cap
4. Ear horn
5. Ear tip
6. Cable port
7. Audio cable
8. Cable strain protection sleeve (Not to scale)
9. Optional ear hangar shaping wire (Not to scale)
10. Vent channel on perimeter of central control unit
11. Back flexible compliant membrane
12. Variable vent channel in back end cap. (Identical vent channel exists in 3. Front end cap, not shown)
13. Back membrane end cap frame
14. Back membrane gasket
15. Back membrane to speaker frame and spacer
16. Speaker front gasket
17. Speaker front spacer
18. Front membrane to speaker frame
19. Front flexible compliant membrane
20. Front membrane end cap frame
21. Interior space of central control unit where speaker (not shown) sits
22. Intersection of front end cap and ear horn where sound filter screen sits
23. Decorative embellishment
24. Screw-in cable connector
25. Headphone jack
26. Cross-earbud cable with Bluetooth fob
27. Over-ear antenna and earbud stabilizer
28. Open end cap with Logo
29. Top vent, exterior basket
30. Top vent, exterior basket, Vent (×3)
31. Top vent, exterior basket, positioning handle
32. Top vent, interior basket
33. Top vent, interior basket, Vent (×3)
34. Top vent, interior basket, positioning handle seat arc
35. Transducers (speakers and amplifiers; ×6)
36. Transducer positioning couplers (×6)
37. Flexible compliant membrane and frame
38. Spacer and Transducer positioner
39. Transducer seat (×6)
40. Side vent, interior basket
41. Side vent, interior basket, Vent (×5)
42. Side vent, interior basket, cable access sliding window
43. Side vent, exterior basket
44. Side vent, exterior basket, Vent (×5)
45. Ear horn
46. Ear tip
47. Cable port
48. Cable pressure connector
49. Power-transferring cable tip
50. Cable protector sleeve
51. Controller
52. Ambient Vent
53. Adjustable Secondary Eustachian Tube
54. Adjustable Valve
55. Membrane Tensioner
56. Membrane Tensioner, top vents
57. Membrane Tensioner, side vents
58. Flexible compliant Membrane
59. Adjustable Secondary Eustachian Tube, ADEL Membrane Seat

60. ADEL Membrane Frame
61. Controller Stem
62. Controller Stem Base Operation of the Invention All embodiments of the Ambrose Earbud are designed to be fully modular. Intersection edges have a ridge and a groove or are smoothly pressure-fitted. Adjacent parts are fitted together by aligning them and manually applying compression. The ridges of the two parts push up and over each other and land in the opposing part's groove. This style of part pairing provides simple and adhesive-free assembly as well as the ability for users and retail customizers to service and exchange parts without the need to purchase a new earbud. The snap-together connection is stable under typical use and snaps apart with reverse pressure.

During the manufacturer's assembly of the A1, employees prepare each end cap, stack the central elements and finish by connecting the end cap sections to the central section. The back membrane is placed within the back membrane frame and the back membrane gasket is pressed over the membrane, holding it fixed in place. The back membrane frame assembly is pressed into the back end cap. Likewise, the front membrane is placed across its designated orifice within the front membrane frame and the front membrane gasket is pressed over top, fixing it in place. The pins of the front membrane frame are placed and pressed into a set of holes on the front end cap, ensuring proper alignment and seal between the front membrane and the front end cap vent channel. The ear horn is pressed into the front end cap and the ear tip onto the ear horn. The speaker is placed within the back membrane-to-speaker frame and spacer and positioned so that the speaker's power connector element is aligned with the notch in the frame. The back membrane-to-speaker frame and spacer is placed inside the central control unit so that the notch is aligned with the cable port. The audio cable tip is passed through the cable port and situated so that the tip's pressure pins rest in their designated grooves in the cable port for proper mating with the speaker. The speaker front gasket is placed within the central control unit on the far side of the notch, after which, the speaker front spacer follows suit. The back end cap section is snapped onto the central control unit and likewise, the front end cap section.

During the manufacturer's assembly of the A2, employees begin with the side vent, exterior basket and fill it with each consecutive element moving outward from the ear (side vent, interior basket; ADEL membrane; transducers and their positioners; the top venting baskets; and the logo endcap). The cable connection assembly is then completed and finally the ear horn and tip.

During the manufacturer's assembly of the A3, employees begin with the controller and its stem. The ambient vent is screwed onto the stem and then the adjustable valve tube is placed around the stem. The controller stem base is snap-fitted into the center of the membrane tensioner and the pair is screwed onto the stem below the adjustable valve. The adjustable secondary Eustachian tube is coaxially placed around the stem and pressure-fitted onto the ambient vent. The ADEL membrane is stretched across the membrane frame and is held firmly in place by the pressure-fit between the membrane frame and the adjustable secondary Eustachian tube.

The user selects their preferred audio connectivity method: via audio cable, cabled Bluetooth, or fully wireless Bluetooth with or without the antenna stabilizer option. The audio cable, Bluetooth cable, and antenna stabilizer each are screwed into the cable jack of the earbud. At the terminus of the cable jack, there is a spring-plate connector across which signal from either cable or antenna is passed. The headphone jack is physically inserted into the user's audio device while the Bluetooth cable receiver or in-earbud receiver is wirelessly paired to the audio device. The user curls and crimps the antenna over their ear.

The user fits either Ambrose Earbud to their own ear geometry and preferred wearing method. The ear horn is first placed into the ear canal and rotated to the most comfortable direction. The front end cap of the A1 is then rotated about with the ear horn maintained in same relative direction to the ear canal to find the appropriate height of entry into the ear canal. With the simpler geometry of the A2 relative to the human ear, the user chooses just the relative angle of the audio cable, if used, to the ear horn. The user then chooses whether they prefer the cable to hang downward or to follow the optional ear hangar over the ear. A user determines through the exchange of ear horn models (described below) and trial and error, which set of ear horn length, curvature, direction and initial height creates the most comfortable fit for their ears.

For the standard earbud use-case of listening to music with no concerns of environmental sounds, the variable vents are open to the barometric air pressure (the A1 end caps are rotated so that the preferred fit is maintained) providing the greatest freedom of movement to the speaker as well as pneumatic pressure dilution away from the tympanic membrane. Venting variations can be used to process the sound according to the user's preference with the A1. The front vent is rotated to a less open to fully closed position to highlight bass sounds and in reverse, a less open back vent highlights mid to high pitches. The spectral processing of the A2 is conducted through programming of the set of transducers. Often, a user is expected to desire a nuanced, intermediate combination of sound isolation while actively listening through their Ambrose Earbuds. A user may be in a loud environment, such as on an airplane or in a noisy crowd, and want more isolation for their music or telephone conversation. To maintain the noiseless spectral characteristics of their audio source, both vents are reduced the same amount.

The Ambrose Earbud acts alternatively as a variable hearing protector. Maximum hearing protection from loud environmental sounds as well as internal occlusion effects is achieved with the speaker powered off. While maintaining the preferred fit, the user rotates the A1 end caps so that the variable vents are aligned through the vent channels on the central control unit to each other or by anti-aligning both sets of the A2 venting baskets. The user rotates the vents to partially open states to acquire partial isolation when they want to hear an external sound at a reduced level, such as while enjoying a rock concert, without sacrificing sound quality. As with an active speaker sound source, bass environmental sounds are highlighted by rotating the A1 front end cap to a reduced venting position and mid to high sounds, the back vent. Another alternative embodiment of the Ambrose Earbud is as a variable hearing protection device only. This embodiment would have no cable port or speaker yet would operate through manipulation of variable vents in a manner identical to the passive Ambrose Earbud acting as a hearing protector.

A user or retail customizer can service or exchange parts of either Ambrose Earbud. The earbud is opened and its internal parts accessed by placing finger tips or a small, strong object such as a penny between parts and exerting pressure against in an external direction. The earbud snaps open and the internal elements can be accessed. Thinner items such as finger nails or a miniature screwdriver are inserted between interior parts to similarly snap them apart. Worn parts are removed, replacements inserted and the earbud is snapped back together by realigning each element. Standard elements are replaced by preferred elements such as higher quality speakers; a denser and conical-bell shaped back A1 end cap for a specific resonance effect; a pair of precious inlayed metal end caps designed by renowned jeweler to highlight a special event; a longer and more curved ear horn for improved fit; etc. A sound filter is not standard but can be snapped into the ear horn during servicing. Once the servicing with all replacements or exchanges made is complete, the user re-assembles the parts and closes the earbud in the same manner as the original manufacturer.

A performer using the Ambrose Tunable Impedance-Matching Acoustic Transformer (A3) rotates the controller outward to reduce and inward to increase the amount of ambient sounds that they can hear. At an intermediate position, they hear some amount of their environmental sounds that is less than available with a fully open ear. The ADEL membrane experiences the least impedance as it is unrestrained by the membrane tensioner and the adjustable secondary Eustachian tube is vented to barometric pressure. Excess pneumatic pressures from sound are readily damped. At the innermost position, the membrane tensioner is in contact with the ADEL membrane and causes its impedance to increase. The membrane's impedance is proportional to the amount of tension placed upon it and has spectral properties. A performer can choose a small or large amount of tension to acquire their desired frequency processing affect. At the outermost position, the adjustable secondary Eustachian tube is isolated from ambient sounds and barometric pressure. The ADEL membrane is not physically tensioned yet it still experiences a high impedance since pressure changes cannot be vented. As with the tensioned membrane, when the adjustable valve is near its maximum diameter, frequency changes can be heard by the performer and controlled to their desired properties. When the ADEL membrane is at its maximum impedance, whether through a sealed vent or through tensioning, the speaker necessarily also experiences maximum impedance. Since pneumatic pressures are not damped via the membrane, they impinge back into the sealed ear canal and impact both the tympanic membrane and the speaker. The reverse is also true. The speaker experiences minimum impedance when the ADEL membrane is most free to flex and dampen the pneumatic pressures of sound.

At music performances with noise-reducing broadcast systems, music is performed on stage with no amplification and microphones pick up the sounds. Attendees sign into the broadcast system with their music devices and select either a location-based delay using methods such as GPS, Wi-Fi or seat numbers or a sound-synchronization method that employs their own device's microphone to detect the live music and calculate a timing offset for the broadcast transmission. The system broadcasts the music to the attendee's audio device delayed by their distance from the performers and modulated by the geometry of the venue in the attendee's instantaneous location. The broadcast signal is passed to the attendee's Ambrose Earbuds, which are adjusted according to the attendee's preferences and as indicated above. Infrasounds, lights, smoke, and other special effects are manipulated to generate energy in the audience and create a unique listening event experience. Performers also sign into the broadcast system and monitor the sound the audience hears by choosing the broadcasts for specific locations across the venue.

A displacement-and-loudness-based digital compression algorithm is integrated into audio processing software such as a music application on a smartphone. The user chooses whether or not to have the digital compression on and, if on, which type of ear tip they are using as each ear tip type has a corresponding upper limit on air displacement from sound before hearing damage can occur. Among ear tips that seal the ear canal, such as foam plugs or mushroom-cap styles, the Ambrose Earbud negates the greatest amount of damage yet requires the least amount of sound volume for a quality listening experience. The user also selects the minimum sound volume across the spectrum and therefore, creates their own customized dynamic range. As each note of music passes through the audio processing software, the digital compression algorithm raises a too quiet pitch to the user's minimum and reduces an overly loud pitch to the maximum volume according to how much air is displaced at its' frequency and the energy dilution of the user's ear tip. The musical note is then passed from the audio processing software to the listener's ear.

I claim:

1. An in-ear audio device comprising:

an enclosure having a sound transducer and being open into a user's ear canal, a vent path through the enclosure from the exterior to the ear canal, the size of the vent path being variable to permit variation of the amount of venting, and a flexible compliant membrane within the enclosure for alleviating the effects of changing pneumatic pressures in the ear canal, and wherein varying the cross section of the vent path through the enclosure varies the pneumatic pressure on the flexible compliant membrane.

2. An in-ear audio device according to claim 1, wherein the enclosure comprises back and front end caps and a control unit between the end caps and housing the sound transducer, wherein the opening, closing or partial opening of the vent path is varied by rotating either or both of the end caps relative to the control unit and/or relative to each other.

3. An in-ear audio device according to claim 1, wherein the audio device includes a pair of nested baskets rotatable relative to each other to vary the cross section of the vent path.

4. An earbud comprising:

a back end cap having an exterior side and an interior side, the interior side of the back end cap rotatably engaging a back of a control unit, a front end cap having an exterior side and an interior side, the interior side rotatably engaging a front of the control unit, the exterior side of the front end cap having an opening for communication with a user's ear canal, wherein the back end cap, the control unit and the front end cap are connected together for rotation independently of each other and about a common axis.

5. An earbud according to claim 4, the control unit including a speaker location for housing a speaker, a flexible compliant membrane between at least one of the end caps and the speaker location.

6. An earbud according to claim 4, including a flexible compliant membrane between each end cap and the speaker location.

7. An earbud according to claim 4, wherein each of the end caps includes on its interior surface a vent opening, the control unit having a circular exterior which engages the two end caps so as to selectively seal off the interior of the two end caps and the control unit.

8. An earbud according to claim 7, the control unit having a plurality of open arches about its periphery which match the size and shape of each of the end cap vent openings so that depending on the rotational position of the control unit relative to each end cap, that end cap can (1) be aligned with an arch on the control unit and thus be sealed off from the exterior, (2) be totally misaligned with any arch so as to be completely open to the exterior or (3) be partially aligned with an arch so as to be partially sealed off by that arch and partially open to the exterior.

9. An earbud according to claim 8, wherein the control unit includes a speaker location for housing a speaker and a flexible compliant membrane between each end cap and the speaker location.

10. An earbud according to claim 8, including an input ear cable port into a side of the control unit.

11. An earbud according to claim 10, wherein the orientation of the cable port can be varied by rotating the control unit relative to the end caps.

12. An earbud according to claim 4, including on the exterior of the front end cap an ear horn to communicate with the user's ear canal.

13. An earbud according to claim 12, wherein the rotational position of the ear horn is variable by rotating the front end cap relative to the control unit.

14. An earbud according to claim 4, wherein the two end caps are attached to the control unit by a snap fit so as to be easily assembled and disassembled.

15. An earbud according to claim 14, including a flexible compliant membrane between each of the end caps and the control unit, and including frame elements holding the flexible compliant membrane in place between the end caps and the control unit, and wherein the frame elements are snap fit into place to secure the flexible compliant membrane.

16. An earbud according to claim 4, including decorative embellishments on the exterior of the back end cap.

17. An earbud comprising:

a back end cap having a vent opening on an interior surface thereof, a front end cap having a vent opening on the interior surface thereof, of the same size and shape as the vent in the back end cap, a control unit between the two end caps which has a cylindrical surface with open arches on the exterior thereof, and the two end caps and the control unit all being rotatable relative to each other and independently about a common axis to provide variable vent paths into the interior of the end caps.

18. An earbud according to claim 17, wherein the vent openings can be closed to the exterior, completely open to the exterior or partially open to exterior, each of these positions thus providing a separate vent path from the exterior into and through the front and back end caps.

19. An earbud according to claim 18, wherein a vent path can be closed to the exterior by being fully in communication with an arch on the control unit, fully open to the exterior by being completely misaligned with an arch on the control unit, or partially open and partially closed by being partially aligned with an arch on the control unit.

20. An earbud according to claim 19, including a speaker location in the control unit, and including a flexible compliant membrane between the speaker location and each end cap, and wherein the various vent paths effect each or both of the flexible compliant membranes depending on the combination of open, closed or partially open position of each vent opening.

21. An earbud comprising;

a top end, a side and a lower end, the top end open to the exterior and including a pair of overlapping baskets, each basket having vent openings, the top baskets being rotatable relative to each other to vary the amount of the air passing through their vent openings, the side including a pair of overlapping baskets, each having vent openings, the side baskets being rotatable relative to each other to vary the amount of air passing through their vent openings, a transducer below the top baskets, a flexible compliant membrane below the transducer, the sides baskets being located below the flexible compliant membrane, and the lower end having an opening to communicate with the user's ear canal.

22. An earbud according to claim 21, wherein the earbud is generally conical in shape with the side tapering from the outer end inwardly toward the lower end.

23. An earbud according to claim 21, wherein the transducer comprises a plurality of separate transducer elements arranged about an axis of the earbud, and the flexible compliant membrane being located below the transducer elements and sealing the earbud between the flexible compliant membrane and the user's ear canal.

24. An earbud according to claim 21, including a handle at the top end which is turnable to vary the relative position of the vents in the baskets at the top end to vary the amount of air passing through these vents.

25. An earbud comprising: an elongated member having an outer end and an inner end, the inner end being locatable at the user's ear canal, wherein the earbud tapers inwardly from the outer end to the inner end, the elongated member having a transducer therein and a flexible compliant membrane closing the earbud between the transducer and the lower end, a first structure being located between the outer end and the transducer and providing variable venting of external air into the transducer side of the flexible compliant membrane, and a second structure being provided along the side of the tapering elongated member and providing variable venting of the external air into the side of the flexible compliant membrane facing the ear canal.

26. An earbud according to claim 25, wherein the two sets of structures provide the user with the ability to identify the direction of ambient sound.

27. An earbud in the form of an in ear monitor which includes a transducer in communication with the user's ear canal, a tube connected between an outer end open to the exterior and the user's ear canal, the tube having a flexible compliant membrane therein, a vent path from the exterior end to the flexible compliant membrane, the vent path being variable in size to control the pneumatic pressure exerted on the flexible compliant membrane, and the vent path including a flow path through the tube which is constricted to close off exterior air to the flexible compliant membrane and open to permit exterior air to flow to the flexible compliant membrane.

28. An earbud according to claim 27, including a screw threaded stem, the end of the stem at the outer end of the tube connected to a turnable controller, the inside end of the stem connected to a membrane tensioner which moves longitudinally along the inside of the tube, at least one flow path connected to the exterior at the outside end of the tube and communicating with the flexible compliant membrane at its inner end, the flow path being bounded in part by an elongated resilient element, wherein as the stem moves inwardly it relaxes the resilient element to thus open the flexible compliant membrane fully to the surrounding atmosphere and wherein when the stem is moved outwardly, it constricts the resilient element to seal off the vent path.

29. An earbud according to claim 28, wherein in the inward position of the stem, with the flow path fully open, the tensioner is in contact with the flexible compliant membrane.

30. An earbud according to claim 27, including a threaded stem with a turnable controller at the outer end of the tube and accessible to the user of the earbud, wherein movement of the turnable controller moves the threaded stem inward and outward, respectively, to open and close the vent path.

31. An earbud according to claim 30, including a resilient element in pad bounding the vent path, and wherein inward movement of the stem relaxes the resilient element and opens the vent path and movement of the stem in the outward direction causes the resilient element to restrict the vent path.

* * * * *